US005558724A

United States Patent [19]

Roche

[11] Patent Number: 5,558,724

[45] Date of Patent: Sep. 24, 1996

[54] METHOD OF INSULATING A MAGNETIC LAMINATION

[75] Inventor: Alain Roche, Villeurbanne, France

[73] Assignee: GEC Alsthom Transport SA, Paris, France

[21] Appl. No.: 526,455

[22] Filed: Sep. 11, 1995

[30] Foreign Application Priority Data

Sep. 12, 1994 [FR] France ..... 94 10860

[51] Int. Cl.[6] ..... C23F 7/10

[52] U.S. Cl. ..... 148/113; 148/24; 148/245

[58] Field of Search ..... 148/113, 24, 245

[56] References Cited

FOREIGN PATENT DOCUMENTS

| | | |
|---|---|---|
| 0459541A1 | 12/1991 | European Pat. Off. . |
| 2176647 | 11/1973 | France . |
| 2369352 | 5/1978 | France . |
| 668496 | 3/1952 | United Kingdom . |

OTHER PUBLICATIONS

*Vide Les Coucehs Minces,* vol. 40, No. 228, 1 Aug. 1985, Paris, FR, pp. 471–478, Pernes, "Influence Des Elements de Surface sur Les Traitements Chimiques Conditionnant L/ Adherence de la Peinture et d'Email sur des Toles D'Acier".

*Database WPI,* Week 7626, Derwent Publications Ltd., London GB, AN 76–49030X–Kobe Steel, "Insulating Film Having Annealing Resistance" & JP–A–51 054 849 15 May 1976.

*Primary Examiner*—Sam Silverberg

*Attorney, Agent, or Firm*—Sughrue, Mion, Zinn, Macpeak & Seas

[57] ABSTRACT

A method for making a lamination insulated by iron-manganese phosphate comprises the following operations:

1. The lamination is treated with an acid or basic medium to eliminate the surface layer of the lamination that contains excess silicon and aluminum.
2. The lamination is rinsed.
3. The lamination is brought into contact with a solution of phosphoric acid containing iron phosphate and manganese phosphate for sufficient time to obtain an insulative layer of the required thickness.

3 Claims, 1 Drawing Sheet

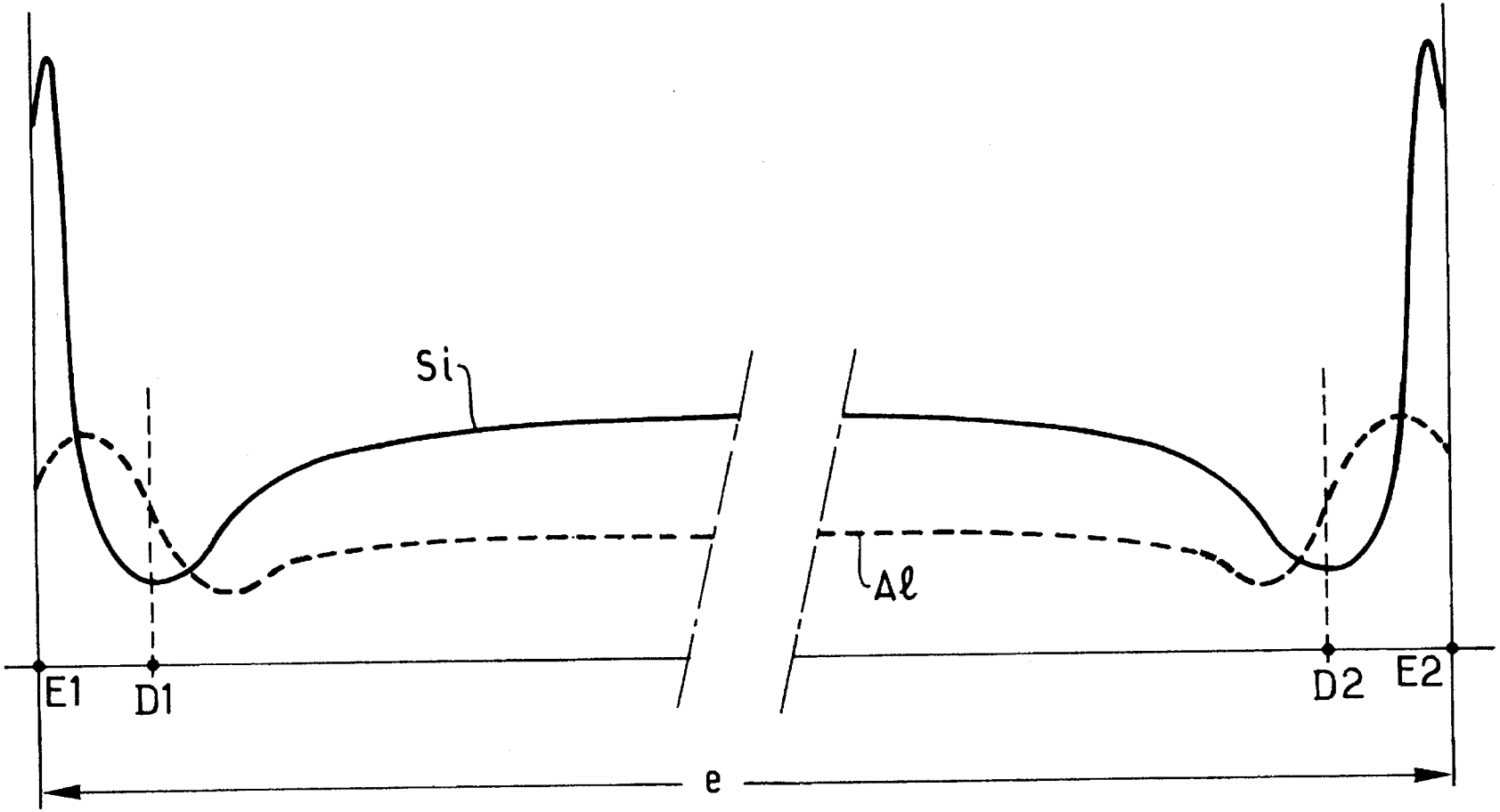
E2
D2
Δℓ
e
Si
D1
E1

METHOD OF INSULATING A MAGNETIC LAMINATION

BACKGROUND OF THE INVENTION

1. Field of the Invention

The present invention concerns magnetic laminations used in particular in the manufacture of electric motor stators.

2. Description of the Prior Art

As is well known, to limit Eddy current losses, magnetic parts of electrical devices such as motors, generators and transformers are made by assembling mutually insulated magnetic laminations.

At present, the silicon laminations used in the manufacture of welded electric motor stators, for example, are insulated by a phosphate varnish; the stators have to undergo a stress relieving treatment at 600° C. which "thins" the insulation. To prevent this thinning loosening the laminations it is necessary to bring it about before assembling and welding the laminations. This additional operation increases the manufacturing cost of the stators.

An object of the present invention is to provide a lamination with insulation that is not "thinned" at a temperature of 600° C.

It is hardly possible, with the lamination insulating methods used at present, to obtain a layer of insulation thicker than about 2 microns. The increasing operating frequencies of electric motors, which lead to an increase in the Eddy currents, require enhanced insulation. The thickness of 2 microns proves insufficient and an insulation layer thickness of around 5 microns to 10 microns is needed; also, this layer must be highly regular, with no "misses" on the lamination.

Another object of the invention is to define a method of producing an insulative layer allowing regular and uniform growth to thicknesses of up to 10 microns.

SUMMARY OF THE INVENTION

All these objects are achieved by the invention which consists in a method for making a lamination insulated by iron-manganese phosphate comprising the following operations:

1. The lamination is treated with an acid or basic medium to eliminate the surface layer of the lamination that contains excess silicon and aluminum,
2. The lamination is rinsed,
3. The lamination is brought into contact with a solution of phosphoric acid containing iron phosphate and manganese phosphate for sufficient time to obtain an insulative layer of the required thickness.

In one specific embodiment of the method, the operation of contact with said solution comprises a first phase of contact with a solution at a pH between 7 and 8 to encourage the seeding of iron-manganese phosphate crystals and a second phase of contact with a solution at a pH between 2 and 4 to encourage the growth of said crystals.

Contact between the lamination and the solution is effected either by dipping or by coating.

BRIEF DESCRIPTION OF THE DRAWINGS

The invention is now explained in detail with reference to the appended drawing in which the single figure represents the proportions of silicon and aluminum in a silicon lamination.

DETAILED DESCRIPTION OF THE INVENTION

The iron and manganese phosphate treatment method invented by the applicant is based on the observation that, in a silicon lamination, the proportion of silicon is not constant throughout the thickness of the lamination.

As shown in the diagram in the accompanying figure, in which the abscissa axis is perpendicular to the plane of the lamination, which is of thickness e between a first edge E1 and a second edge E2, the proportion of silicon, plotted on the ordinate axis with an arbitrary scale Si (full line curve), features a particularly high concentration near the edges. Likewise the aluminum Al that lamination manufacturers incorporate for ease of manufacture into silicon laminations (dashed line curve). Silicon and aluminum poison the seeding and growth of iron-manganese phosphate crystals.

This is why, in accordance with the invention, the phosphate treatment of the lamination comprises a first phase to eliminate the surface layer of the lamination. This stage of the treatment continues until the proportion of silicon is close to the minima shown on the curve, i.e. in the vicinity of the points D1 and D2 in the diagram; the poisoning effect of the silicon and the aluminum is thus considerably attenuated, which allows the phosphate to grow.

The surface layer can be treated using an acid or a basic medium. The pH of the treatment solution and the treatment time are determined experimentally by microscopic examination of samples of the lamination.

After rinsing, the lamination is brought into contact with a solution of phosphoric acid containing iron phosphate and manganese phosphate either by dipping in a bath or by coating (i.e. passage between rollers impregnated with the solution). The latter method lends itself better to automation of lamination treatment.

Contact between the lamination and the solution is preferably effected in two phases:

- a first phase using a solution at a pH between 7 and 8 to encourage the seeding of iron-manganese phosphate crystals,
- a second phase using a solution at a pH between 2 and 4 to grow the phosphate crystals.

The contact time in each phase can be determined experimentally to obtain the required thickness of the insulative layer and regular and homogeneous growth of the crystals.

Iron-manganese phosphate has been chosen for various reasons:

- its good electrical resistivity,
- the regular shape of the crystals, which are substantially cubic, enabling a particularly homogeneous layer to be obtained on the surface of the lamination,
- insensitivity to temperatures in the order of 600° C. to which the laminations may be exposed after assembly,
- the possibility of easily obtaining insulative layers up to 10 microns thick.

The invention applies to all silicon magnetic laminations in all electrotechnical applications.

There is claimed:

1. A method for making a silicon magnetic lamination insulated with an iron-manganese phosphate coating that does not undergo substantial thinning when stress relieved at 600° C., comprising: eliminating excess silicon and aluminum from the surface of a silicon magnetic substrate to allow the seeding and growth of iron-manganese phosphate crystals; and treating the surface with a solution of manganese phosphate to form an insulation coating of about 5 microns to 10 microns.

2. Method according to claim 1 wherein the operation of contact with said solution comprises a first phase of contact with a solution at a pH between 7 and 8 to encourage the seeding of iron-manganese phosphate crystals and a second phase of contact with a solution at a pH between 2 and 4 to encourage growth of said crystals.

3. Method according to claim 1 wherein the contact between said lamination and said solution is effected either by dipping or by coating.

* * * * *